US009268274B2

(12) United States Patent
Kondo

(10) Patent No.: US 9,268,274 B2
(45) Date of Patent: Feb. 23, 2016

(54) FIXING DEVICE HAVING RESTRICTING MEMBER TO RESTRICT END FACE OF ENDLESS BELT

(71) Applicant: Tomohiro Kondo, Nagoya (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/169,181

(22) Filed: Jan. 31, 2014

(65) Prior Publication Data

US 2014/0212189 A1 Jul. 31, 2014

(30) Foreign Application Priority Data

Jan. 31, 2013 (JP) ..... 2013-017139

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS 4,429,985 A * 2/1984 Yokota ..... 399/165
4,657,372 A * 4/1987 Ikeda et al. ..... 399/13
5,873,016 A * 2/1999 Kurokawa et al. ..... 399/297
5,896,979 A * 4/1999 Hokari et al. ..... 198/807
5,960,243 A * 9/1999 Daigo et al. ..... 399/329
6,002,908 A * 12/1999 Hayashi et al. ..... 399/312
8,824,939 B2 * 9/2014 Yamamoto et al. ..... 399/302
2003/0185604 A1 * 10/2003 Sato ..... 399/329
2005/0008412 A1 * 1/2005 Aruga et al. ..... 399/329
2005/0185994 A1 * 8/2005 Inada et al. ..... 399/328
2006/0233575 A1 * 10/2006 Uchida et al. ..... 399/329
2006/0245798 A1 * 11/2006 Nakayama ..... 399/329
2008/0170894 A1 * 7/2008 Ishida et al. ..... 399/329
2008/0240807 A1 * 10/2008 Lee et al. ..... 399/329
2008/0292374 A1 * 11/2008 Hiraoka et al. ..... 399/328
2009/0047047 A1 * 2/2009 Ardery et al. ..... 399/329
2009/0202275 A1 * 8/2009 Nishida et al. ..... 399/165
2011/0129267 A1 * 6/2011 Arimoto et al. ..... 399/329
2011/0158691 A1 * 6/2011 Foster et al. ..... 399/122
2011/0236087 A1 * 9/2011 Yagi et al. ..... 399/329
2012/0027478 A1 * 2/2012 Tsukioka ..... 399/329
2012/0163884 A1 6/2012 Kondo et al.
2013/0010315 A1 * 1/2013 Yazawa et al. ..... 358/1.12
2013/0272762 A1 * 10/2013 Uekawa et al. ..... 399/329

FOREIGN PATENT DOCUMENTS

JP 06064773 A * 3/1994 ..... B65H 5/02
JP 2012-137517 A 7/2012

* cited by examiner

*Primary Examiner* — David Bolduc
(74) *Attorney, Agent, or Firm* — Banner & Witcoff, Ltd.

(57) ABSTRACT

There is provided a fixing device that may include: an endless belt having an inner peripheral surface defining an internal space and configured to circularly move about a first axis extending in an axial direction; a heater and a nip plate extending through the internal space; a rotary body; a restricting member and a biasing member. The rotary body and the nip member may nip the endless belt therebetween. The restricting member may restrict displacement of the endless belt in the axial direction, the restricting member having a restricting surface configured to oppose an axial end face of the endless belt in the axial direction. The biasing member may bias the restricting member toward the axial end face of the endless belt.

8 Claims, 12 Drawing Sheets

FIXING DEVICE HAVING RESTRICTING MEMBER TO RESTRICT END FACE OF ENDLESS BELT

CROSS REFERENCE TO RELATED APPLICATION

This application claims priority from Japanese Patent Application No. 2013-017139 filed Jan. 31, 2013. The entire content of the priority application is incorporated herein by reference.

TECHNICAL FIELD

The present invention relates to a fixing device provided in an electrophotographic image forming apparatus.

BACKGROUND

A conventional electrophotographic image forming apparatus (such as a later printer or digital copier) includes a fixing device that thermally fixes a developing agent image formed on a recording sheet thereto. Such conventional fixing device includes a flexible endless fusing film (or an endless belt), a heater disposed in an internal space of the fusing film, a nip plate disposed in the internal space and in sliding contact with an inner peripheral surface of the fusing film to receive radiant heat from the heater, and a pressure roller that nips the fusing film together with the nip plate to permit the endless fusing film to be circularly movable in a circumferential direction thereof.

In this fixing device, a developing agent image formed on a recording sheet is thermally fixed to the recording sheet with radiant heat from the heater while the recording sheet is nipped and conveyed between the pressure roller and the fusing film.

This fixing device is also provided with a pair of restricting members configured to restrict end faces of the fusing film in an axial direction thereof. The restricting members serve to prevent the recording sheet from deviating from its sheet conveying direction while the sheet is nipped and conveyed between the pressure roller and the fusing film. These restricting members are configured to tilt relative to a surface perpendicular to an axis of the endless fusing belt.

SUMMARY

However, under the configuration of the above-described fixing device, the fusing film (endless belt) is applied with a pressing force acting in the axial direction from the pressure roller (rotary body), causing the axial end face of the fusing film to be pressed against the corresponding restricting member. The fusing film is therefore caused to slant relative to the axial direction. Since the restricting member is caused to tilt in accordance with slant of the fusing film, the fusing film may be kept slanted relative to the axial direction, possibly producing an adverse effect on conveyance of recording sheets.

Further, in case that the fusing film (endless belt) has a rubber layer as an outer layer, the pressing force applied to the fusing film from the rotary body could be even stronger due to a grippy nature of the rubber layer. If this is the case, the axial end face of the endless belt could be tightly pressed against the restricting member. If such tight-pressing of the axial end face of the endless belt against the restricting member repeatedly occurs, the axial end face of the endless belt could be distorted or damaged.

In view of the foregoing, it is an object of the present invention to provide a fixing device capable of preventing axial end faces of an endless belt from being damaged or distorted, and also capable of moving the endless belt back to its original orientation aligned in the axial direction.

In order to attain the above and other objects, there is provided a fixing device including an endless belt, a heater, a nip member, a rotary body, a restricting member and a biasing member. The endless belt may have an inner peripheral surface defining an internal space and may be configured to circularly move about a first axis extending in an axial direction, the endless belt having an axial end face. The heater may extend through the internal space. The nip member may extend through the internal space. The rotary body and the nip member may be configured to nip the endless belt therebetween. The restricting member may be configured to restrict displacement of the endless belt in the axial direction, the restricting member having a restricting surface configured to oppose the axial end face of the endless belt in the axial direction.

DETAILED DESCRIPTION

Figure 1:
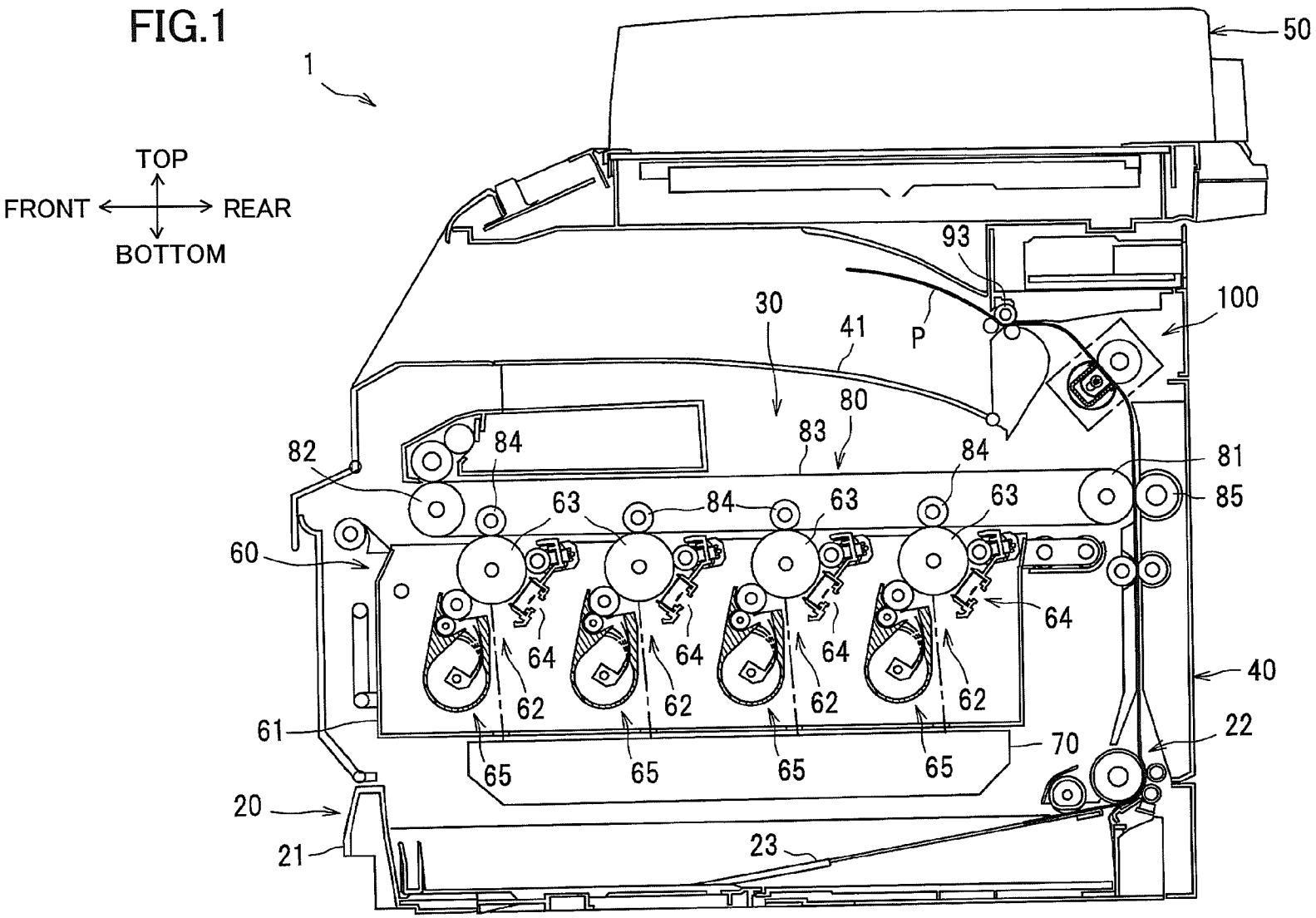
FIG. 1 is a schematic cross-sectional side view illustrating a general configuration of a color printer provided with a fixing device according to an embodiment of the present invention.

First, a general structure of a color printer 1 as an image forming device according to an embodiment of the present invention will be described with reference to FIG. 1. The color printer 1 shown in FIG. 1 is provided with a fixing device 100 according to the embodiment of the present invention. A detailed structure of the fixing device 100 will be described later with reference to FIGS. 2 through 10.

<General Structure of Laser Printer>

In FIG. 1, a right side, a left side, a near side and a far side will be referred to as a rear side, a front side, a right side and a left side of the color printer 1, respectively.

As shown in FIG. 1, the color printer 1 includes a main frame 40. Within the main frame 40, a sheet feeding unit 20 for feeding a sheet P, and an image forming unit 30 for forming an image on the sheet P are provided. The color printer 1 is also provided with a flat head scanner 50 disposed upward of the main frame 40. The image forming unit 30 includes a process unit 60, an exposure device 70, a transfer unit 80, and the fixing device 100.

The sheet feeding unit 20 is disposed at a lower portion of the main frame 40. The sheet feeding unit 20 includes a sheet tray 21 for accommodating the sheet P, a sheet feeding mechanism 22 disposed rearward of the sheet tray 21, and a lifter plate 23 for conveying the sheet P accommodated in the sheet tray 21 to the sheet feeding mechanism 22. The sheet P (rear end portion of the sheet P) accommodated in the sheet tray 21 is lifted upward by the lifter plate 32, separated one by one and conveyed upward by sheet feeding mechanism 22.

The process unit 60 includes a retaining case 61 and four process cartridges 62 accommodated in the retaining case 61. The four process cartridges 62 are juxtaposed in a front-rear direction at predetermined intervals.

Each process cartridge 62 includes a photosensitive drum 63, a charger 64, and a developing cartridge 65. The photosensitive drum 63 has a photosensitive layer as an outer peripheral surface. The charger 64 applies a uniform charge to the photosensitive layer of the photosensitive drum 63. The developing cartridge 65 is configured to supply developer to the photosensitive layer of the photosensitive drum 63. The photosensitive drum 63 is provided in an upper portion of the process cartridge 62. The charger 64 is disposed rearward of the photosensitive drum 63, and the developing cartridge 65 is disposed below the photosensitive drum 63.

In each process cartridge 62, after uniformly charged by the charger 64, the photosensitive layer of the photosensitive drum 63 is subjected to high speed scan of a laser beam emitted from the exposure device 70 (described next). An electrostatic latent image based on image data is thereby formed on the photosensitive layer of the photosensitive drum 63. Toner accommodated in the developing cartridge 65 is then supplied to the electrostatic latent image. Hence, the electrostatic latent image is developed into a visible toner image on the outer peripheral surface of the photosensitive drum 63.

The exposure device 70 is disposed above the sheet supply unit 20 and below the process unit 60 within the main frame 40. The exposure device 70 includes a laser source, a polygon mirror, lenses and reflection mirrors (all not shown). In the exposure device 70, the laser source emits a laser beam. The laser beam is reflected by or passes through the polygon minor, the lenses, and the reflection mirrors such that the laser beam is irradiated on the outer peripheral surface of the photosensitive drum 63 at a high speed. The surface of a photosensitive drum 63 is thus exposed to light.

The transfer unit 80 is disposed upward of the process unit 60 within the main frame 40. The process unit 60 includes a drive roller 81, a follow roller 82 and an intermediate belt 83. The drive roller 81 is positioned above the sheet feeding mechanism 22. The follow roller 82 is disposed frontward of the drive roller 81 and is spaced away therefrom in the front-rear direction. The intermediate belt 83 is mounted (stretched) on and around the drive roller 81 and the follow roller 82.

The transfer unit 80 also includes four primary transfer rollers 84 and a secondary transfer roller 85. The primary transfer rollers 84 are disposed in an internal space of the intermediate belt 83 such that each primary transfer roller 84 opposes and is in pressure contact with each of the photosensitive drums 63 to nip a lower portion of the intermediate belt 83 therebetween. The secondary transfer roller 85 is disposed to oppose the drive roller 81 such that the secondary transfer roller 85 is pressed against the intermediate belt 83 from its rear side.

In the transfer unit 80, the toner image of each color formed on the surface of each photosensitive drum 63 is sequentially superimposed on the intermediate belt 83. The colored toner image superimposed on the intermediate belt 83 is then transferred onto the sheet P conveyed upward from the sheet feeding mechanism 22 while the sheet P is pressed against the intermediate belt 83 by the secondary transfer roller 85.

The fixing device 100 is disposed rearward of and upward of the transfer unit 80 within the main frame 40. The sheet P passing between the drive roller 81 and the secondary transfer roller 85 is conveyed upward to the fixing device 100, whereby the colored toner image transferred to the sheet P from the intermediate belt 83 is thermally fixed to the sheet P. The sheet P having the color image fixed thereto is finally discharged onto a discharge tray 41 by a discharge roller 93.

<Detailed Structure of Fixing Device>

Next, a detailed structure of the fixing device 100 according to the embodiment will be described with reference to FIGS. 2 through 10.

Figure 2:
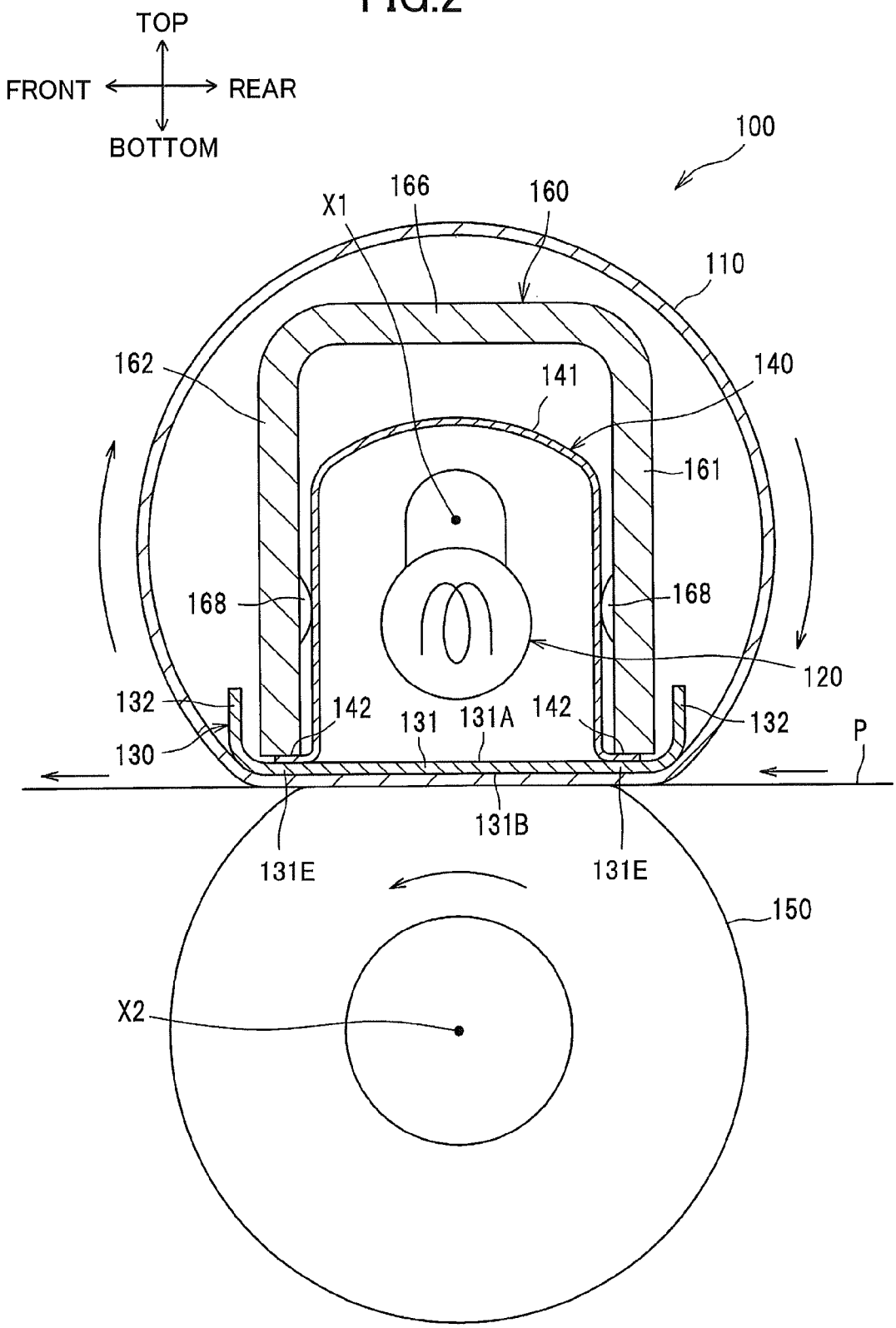
FIG. 2 is a schematic cross-sectional view illustrating a general configuration of the fixing device according to the embodiment, the fixing device including an endless belt.

In FIG. 2, a right side, a left side, a near side and a far side will be referred to as a rear side, a front side, a left side and a right side of the fixing device 100, respectively. Further, in FIG. 4, a left side, a right side, an upper-left side and a lower-right side will be referred to as a rear side, a front side, a left side and a right side of the fixing device 100, respectively.

As shown in FIG. 2, the fixing device 100 includes a flexible endless belt 110 for fusing, a halogen lamp 120, a nip plate 130, a reflection plate 140, a pressure roller 150 and a stay 160.

In the following description, a direction in which the sheet P is fed (a front-rear direction in the embodiment) will be referred to as a sheet feeding direction, which is shown as an arrow in FIG. 2.

The endless belt 110 is of an endless film (of a tubular configuration) having heat resistivity and flexibility. The endless belt 110 has an inner peripheral surface that defines an internal space for accommodating the halogen lamp 120, the nip plate 130, the reflection plate 140 and the stay 160. The endless belt 110 defines an imaginary axis X1 extending in an imaginary axial direction X1 (left-right direction in the embodiment or longitudinal direction) about which the endless belt 110 is circularly movable. The imaginary axis X1 (imaginary axial direction X1) is perpendicular to the sheet feeding direction. Movement of the endless belt 110 in the imaginary axial direction X1 (left-right direction) is guided by restricting members 180 (described later).

Figure 3:
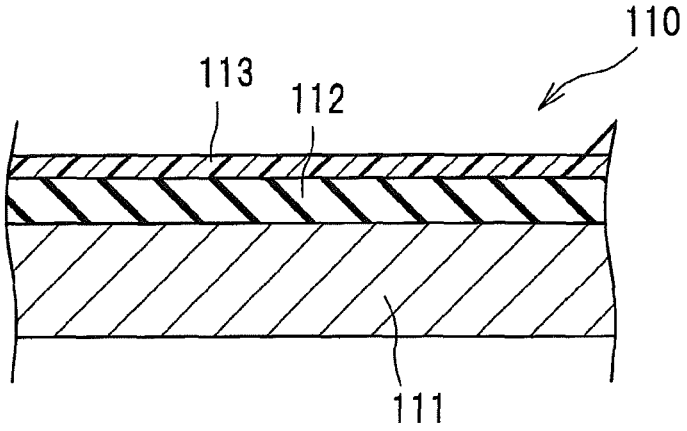
FIG. 3 is a partially-enlarged cross-sectional view showing a layered structure of the endless belt of FIG. 2.

Specifically, the endless belt 110 is configured of a base layer 111, a rubber layer 112 as an intermediate layer, and a fluorine resin layer 113 as an outermost layer, as shown in FIG. 3. The base layer 111 has an outer surface covered by the rubber layer 112. The rubber layer 112 has an outer surface covered with the fluorine resin layer 113.

Figure 4:
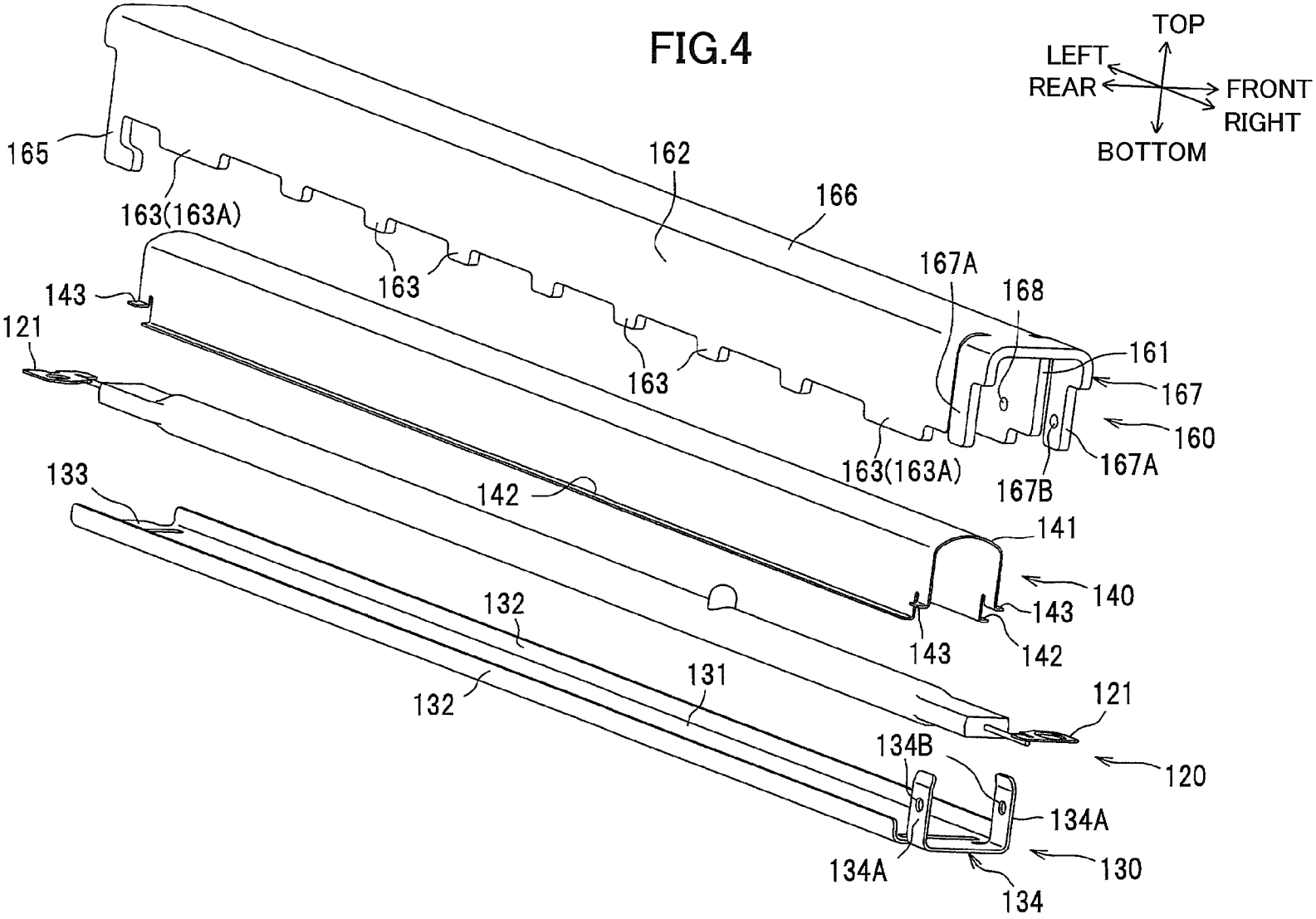
FIG. 4 is an exploded perspective view of components of the fixing device according to the embodiment.

The halogen lamp 120 is a well-known heater configured to emit radiant heat to heat the nip plate 130 and the endless belt 110 for heating toner on the sheet P. The halogen lamp 120 is positioned to extend through the internal space of the endless belt 110 and extends in a direction parallel to the imaginary axis X1. The halogen lamp 120 is positioned to be spaced away from the inner peripheral surface of the endless belt 110 and an upper surface 131A (described next) of the nip plate 130 respectively by a predetermined distance. As shown in FIG. 4, an electrical terminal 121 is provided at each longitudinal end of the halogen lamp 120.

The nip plate 130 has a plate shape extending in the left-right direction (longitudinal direction). The nip plate 130 extends through the internal space of the endless belt 110. The nip plate 130 is configured to contact the inner peripheral surface of the endless belt 110. The nip plate 130 is adapted for receiving radiant heat from the halogen lamp 120 and for transmitting the radiant heat to the toner on the sheet P through the endless belt 110.

The nip plate 130 has a generally flat U-shaped cross-section taken along a plane perpendicular to the longitudinal direction of the nip plate 130. The nip plate 130 is made from a material such as aluminum having a thermal conductivity higher than that of the stay 160 (described later) made from steel. More specifically, for fabricating the nip plate 130, an aluminum plate is bent into a flat U-shape to provide a base portion 131 and upwardly folded side wall portions 132.

The base portion 131 has the upper surface (inner surface) 131A and a lower surface 131B opposite to the upper surface 131A. The upper surface 131A faces the halogen lamp 120 to receive radiant heat therefrom (see FIG. 2). The upper surface 131A may be painted with black color or provided with a heat absorbing member to effectively receive radiant heat from the halogen lamp 120.

As shown in FIG. 2, the lower surface 131B of the base portion 131 is configured to be in sliding contact with the inner peripheral surface of the endless belt 110. The lower surface 131B may be covered with an oxide layer or a fluorine resin coating layer.

The base portion 131 is flat and extends in the left-right direction. The base portion 131 has a width (front-rear dimension) in the sheet feeding direction. In the embodiment, the sheet feeding direction is coincident with the front-rear direction of the nip plate 130. The base portion 131 has front and rear end portions 131E (see FIG. 2). The side wall portions 132 extend upward respectively from the front and rear end portions 131E of the base portion 131.

As shown in FIG. 4, the base portion 131 has a left end portion provided with an insertion portion 133 extending flat, and a right end portion provided with an engagement portion 134. The engagement portion 134 has a U-shaped configuration as viewed from its right side and includes front and rear wall portions 134A extending upward. Each of the front and rear wall portions 134A is formed with an engagement hole 134B.

The reflection plate 140 configured into U-shape in cross-section. The reflection plate 140 has a U-shaped reflection portion 141 and a flange portion 142 extending from each end portion of the reflection portion 141 in the sheet feeding direction.

Figure 5:
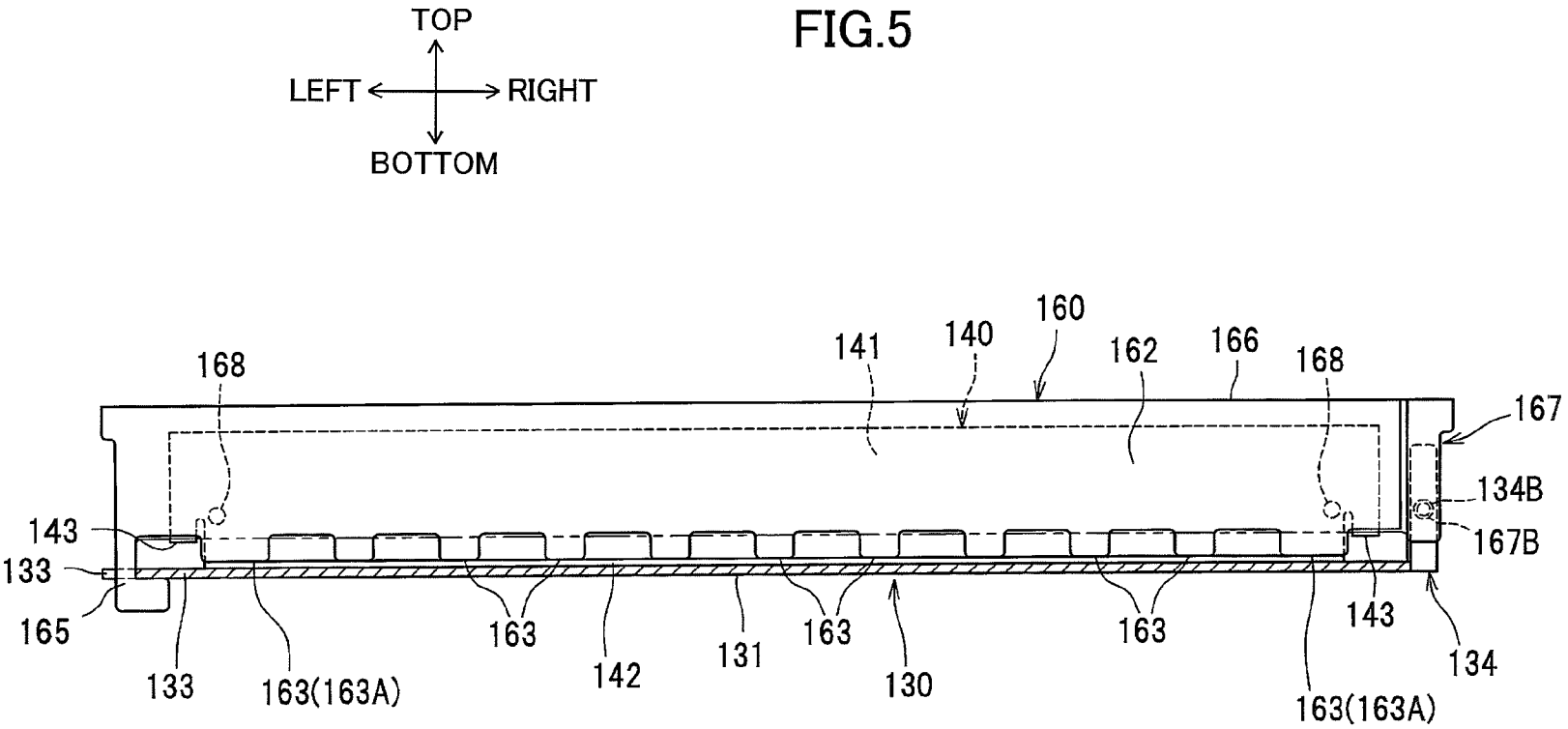
FIG. 5 is a rear side view illustrating an assembled state of the components of the fixing device according to the embodiment.

As shown in FIG. 4, two engagement sections 143 are formed at each longitudinal end of the reflection plate 140 (only three of four engagement sections 143 are shown in FIG. 4). Each engagement section 143 is positioned higher than the flange portion 142. As a result of assembly of the nip plate 130 together with the reflection plate 140 and the stay 160 as shown in FIG. 5, comb-like contact portions 163 (163A) of the stay 160 described later are interposed between the right and left engagement sections 143. That is, the right engagement section 143 is in contact with the rightmost contact portion 163A, and the left engagement section 143 is in contact with the leftmost contact portion 163A.

The pressure roller 150 is formed of an elastically deformable material. The pressure roller 150 is positioned below the nip plate 130, as shown in FIG. 2. In an elastically deformed state, the pressure roller 150 nips the endless belt 110 in cooperation with the nip plate 130 to provide a nip region for nipping the sheet P between the pressure roller 150 and the endless belt 110. To provide the nip region, a biasing member, such as a coil spring, may be provided to bias the pressure roller 150 toward the nip plate 130 or vice versa.

The pressure roller 150 is driven by a motor (not shown) disposed in the main frame 40 to rotate about an imaginary axis X2 (shown in FIG. 2) generally parallel to the imaginary axis X1 of the endless belt 110. By the rotation of the pressure roller 150 about the imaginary axis X2, the endless belt 110 is caused to circularly move about the imaginary axis X1 because of a frictional force generated between the pressure roller 150 and the sheet P, and between the sheet P and the endless belt 110. The toner image on the sheet P can be thermally fixed thereon by heat and pressure during passage of the sheet P at the nip region between the pressure roller 150 and the endless belt 110.

The stay 160 is adapted to support the front and rear end portions 131E of the nip plate 130 via the flange portions 142 of the reflection plate 140 for maintaining rigidity of the nip plate 130. The stay 160 has a U-shape configuration in conformity with an outer profile of the reflection plate 140 (reflection portion 141) for covering the reflection plate 140. For fabricating the stay 160, a highly rigid member such as a steel plate is folded into U-shape to provide a top wall 166, a front wall 161 and a rear wall 162.

As shown in FIG. 3, each of the front wall 161 and the rear wall 162 has a lower end portion formed with comb-like contact portions 163.

The front and rear walls 161, 162 have left end portions provided with L-shaped engagement legs 165 each extending downward and then leftward. The top wall 166 has a right end portion provided with a retainer 167 having U-shaped configuration in a right side view. The retainer 167 has a pair of retaining walls 167A each of whose inner surfaces is provided with an engagement boss 167B protruding inward (only one engagement boss 167B is shown in FIG. 4).

As shown in FIGS. 2 and 4, each of the front wall 161 and the rear wall 162 has longitudinal end portions whose inner surfaces are each provided with an abutment boss 168 protruding inward therefrom. The abutment bosses 168 are in abutment with an outer surface of the reflection portion 141 (see FIG. 2). Therefore, displacement of the reflection plate 140 in the sheet feeding direction due to vibration caused by operation of the fixing device 100 can be restrained because of the abutment of the reflection portion 141 with the bosses 168.

Assembling procedure of the reflection plate 140 and the nip plate 130 to the stay 160 will now be described.

First, the reflection plate 140 is coupled to the stay 160. The reflection plate 140 is temporarily assembled to the stay 160 by the abutment of the outer surface of the reflection portion 141 on the abutment bosses 168. At this time, the engagement sections 143 are brought into contact with the outermost contact portions 163A in the longitudinal direction.

Then, as shown in FIG. 5, the insertion portion 133 of the nip plate 130 is inserted between the engagement legs 165, 165, so that the base portion 131 (both end portions 131E) are brought into engagement with the engagement legs 165, 165. Thereafter, the engagement bosses 167B of the retainer 167 are engaged with the corresponding engagement holes 134E of the engagement portion 134 of the nip plate 130. By this engagement of the both end portions 131E with the engagement legs 165 and the engagement of the engagement portion 134 with the retainer 167, the nip plate 130 is held to the stay 160. Also, the reflection plate 140 is held to the stay 60 such that each flange portion 142 of the reflection plate 140 is sandwiched between the nip plate 130 (each end portion 131E) and the stay 160. The nip plate 130 and the reflection plate 140 are thus held to the stay 160.

Figure 6:
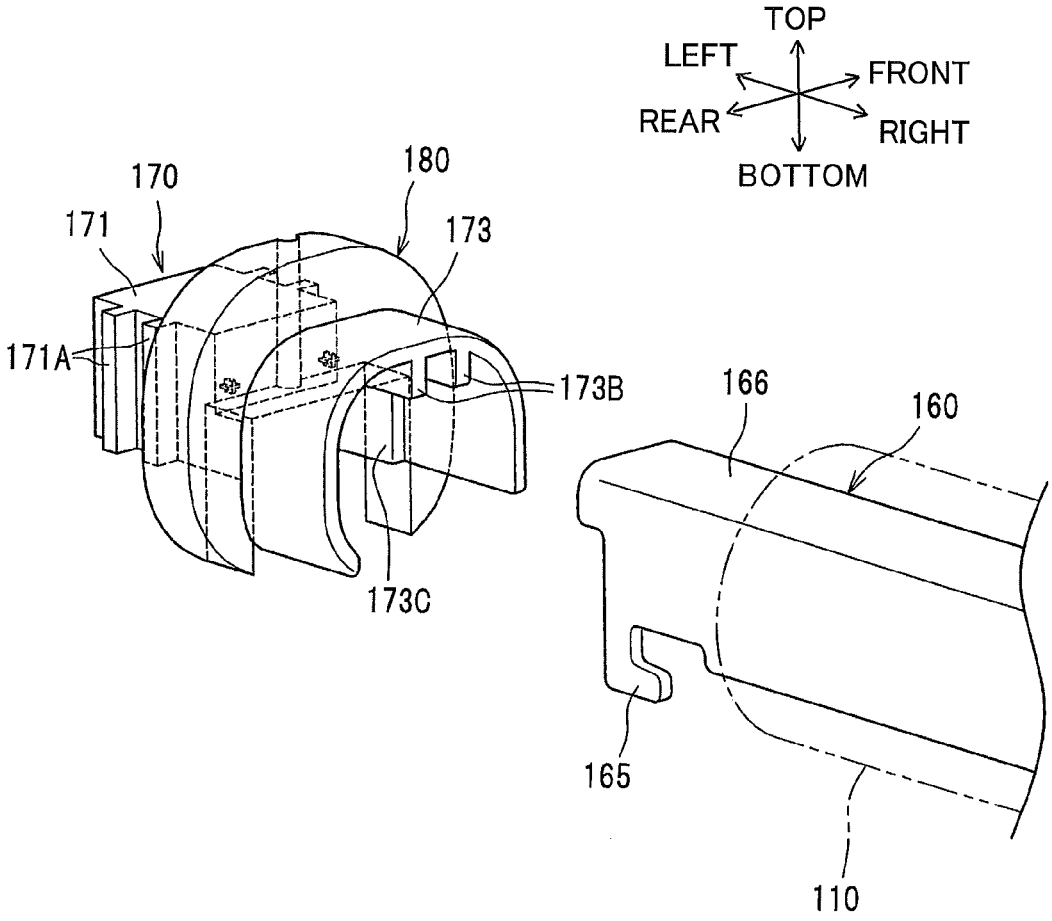
FIG. 6 is a view illustrating an assembled state of a frame and a restricting member provided in the fixing device according to the embodiment.
Figure 7:
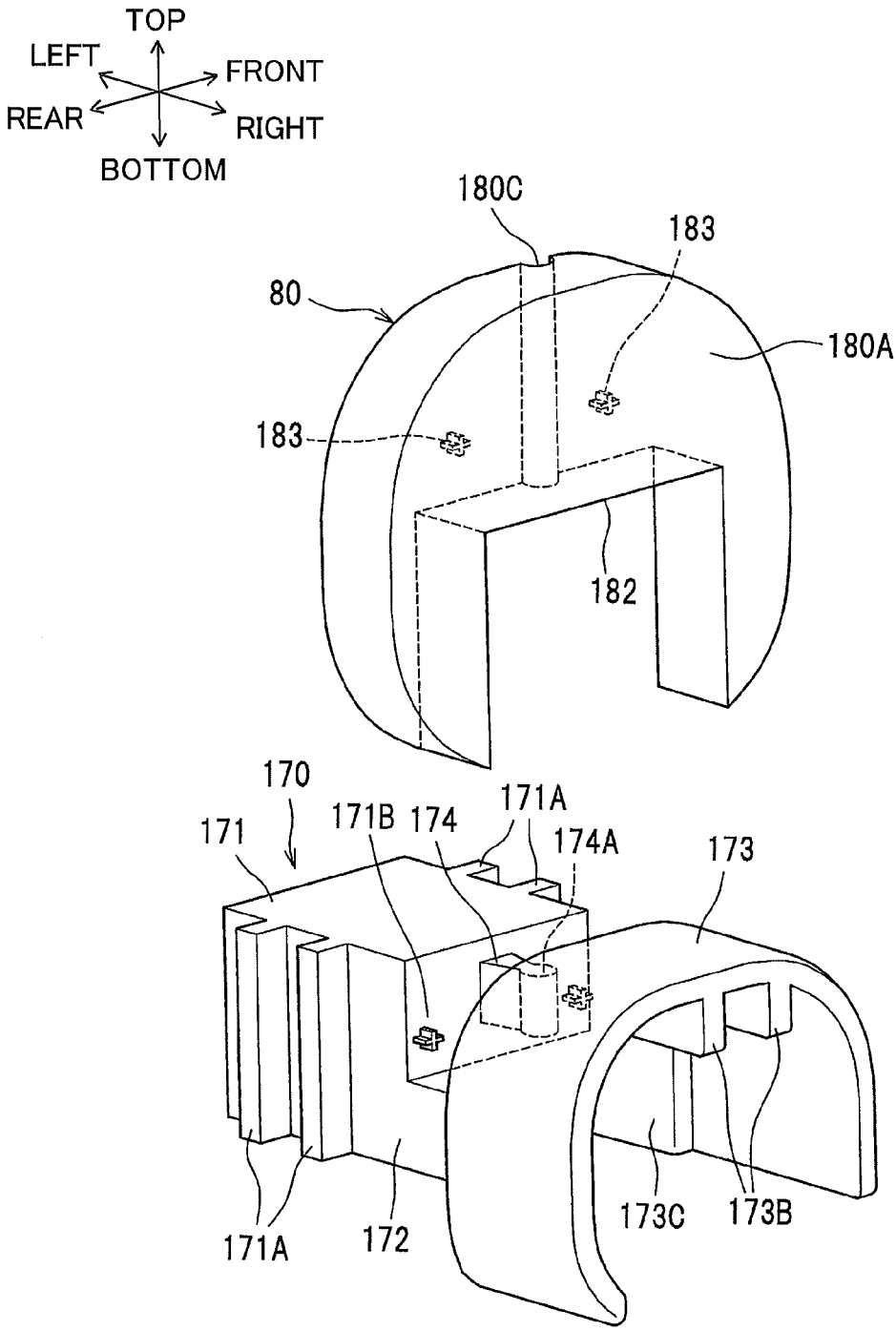
FIG. 7 is an exploded perspective view of the frame and the restricting member according to the embodiment.

Then, the stay 160 holding the nip plate 130 and the reflection plate 140 while surrounding the halogen lamp 120 is held to a pair of frames 170 as shown in FIGS. 6 and 7 (in which one is shown FIGS. 6 and 7). That is, the stay 160 has both longitudinal ends each supported to one of the frames 170. A restricting member 180 is assembled to each frame 170 for restricting movement of the endless belt 110 in the imaginary axial direction X1.

As show in FIG. 7, each frame 170 is made from a synthetic resin and integrally includes a frame section 171, an inner guide section 173, and an arm section 172 connecting between the frame section 171 and the inner guide section 173.

The frame section 171 is fixed to the main frame 40 of the color printer 1. The frame section 171 has a generally rectangular block-like shape. The frame section 171 has front and rear walls (shown without reference numerals) opposing each other and parallel to each other in the front-rear direction (sheet feeding direction). Put another way, the front wall is positioned upstream of the rear wall in the sheet feeding direction. Each of the front and rear walls is formed with a pair of protruding ribs 171A extending vertically. The protruding ribs 171A extend vertically and are spaced away from each other in the left-right direction. The protruding ribs 171A are provided for fixation of the frame 170 to the main frame 40.

The frame section 171 has a right side wall extending in the front-rear direction and connecting between the front and rear walls of the frame section 171. The arm section 172. The right side wall of the frame section 171 has a bottom portion from which the arm section 172 protrudes rightward toward axial end faces of the endless belt 110 for connecting the frame section 171 and the inner guide section 173 (see FIG. 6). The right side wall of the frame section 171 has an upper portion on which a pair of spring receiving bosses 171B, 171B and a supporting portion 174 are formed. The spring receiving bosses 171B, 171B are arranged to oppose each other in the front-rear direction for supporting compression springs 190A and 190B, as will be described later. The supporting portion 174 is positioned between the pair of spring receiving bosses 171B, 171B in the front-rear direction and protrudes rightward from the upper portion of the right side wall of the frame section 171. The supporting portion 174 is configured to tiltably support the corresponding restricting member 180, as will be described later in greater detail.

The inner guide section 173 is configured to guide the inner peripheral surface of the endless belt 110. The inner guide section 173 has a cross-section in conformance with the inner peripheral surface of the endless belt 110. That is, the inner guide section 173 has a generally C-shape having a cutout part in the bottom. The inner guide section 173 has an outer surface configured to be in sliding contact with the inner peripheral surface of the endless belt 110 to guide the circular movement of the same (movement of the endless belt 110 in a circumferential direction thereof). The stay 160 is fittingly inserted into the inner guide section 173 through the cutout part thereof.

Figure 9:
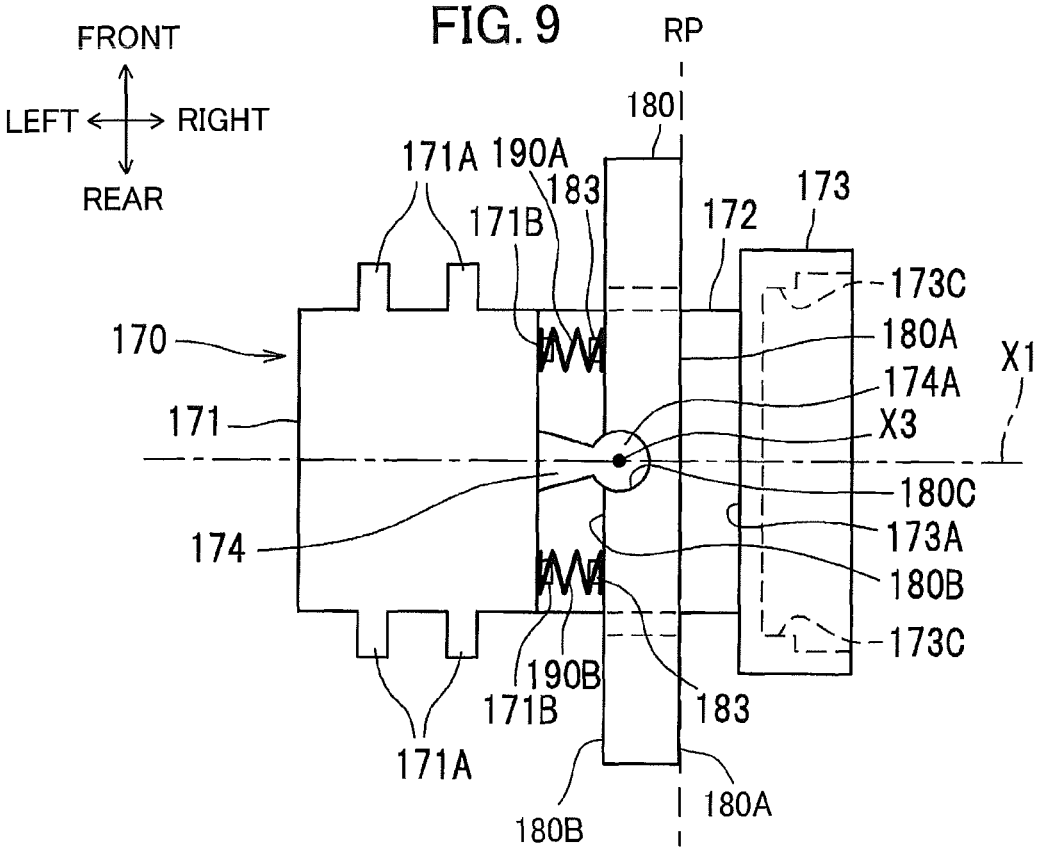
FIG. 9 is a plan view showing the assembled state of the frame and the restricting member according to the embodiment.

The inner guide section 173 includes an upper wall (shown without reference number), a side wall (left side wall) 173A, a pair of abutment portions 173B, 173B and a pair of retaining walls 173C, as shown in FIGS. 7 and 9. The side wall 173A extends from the arm section 172 and is parallel to the right side wall of the frame section 171. The abutment portions 173B, 173B are integrally formed with the upper wall 173A for supporting the top wall 166 of the stay 160. Each abutment portion 173B is a rib protruding downward from an inner surface of the upper wall of the inner guide section 173 and extending in the right-to-left direction. The retaining walls 172 are integrally formed on inner surfaces of front and rear walls of the inner guide section 173 to oppose each other in the front-rear direction, as shown by dotted lines in in FIG. 9. The retaining walls 172 serve to nip the front wall 161 and the rear wall 162 of the stay 160 in the front-rear direction.

Although not shown in the drawings, the inner guide section 173 is also provided with a fixing portion for fixing the terminal 121 of the halogen lamp 120 (FIG. 4).

The restricting member 180 is configured to restrict displacement of the endless belt 110 in the imaginary axial direction X1, or to prevent the endless belt 110 from moving excessively in the left-right direction. The restricting member 180 is shaped like a letter C with an opening downward in a right side view. Specifically, the restricting member 180 has a generally circular-shaped cross-section in a right side view, having a lower portion formed with a rectangular-shaped cutout portion 182 opening downward. This rectangular-shaped cutout portion 182 serves as a coupling recess 182. The restricting member 180 has a right side wall 180A configured to abut against the axial end face of the endless belt 110. This right side wall 180A serves as a restricting surface 180A to restrict displacement of the endless belt 110 in the imaginary axial direction X1. The coupling recess 182 of the restricting member 180 is coupled to the arm section 172 from above such that the restricting surface 180A faces the inner guide section 173 in the left-right direction.

Figure 10:
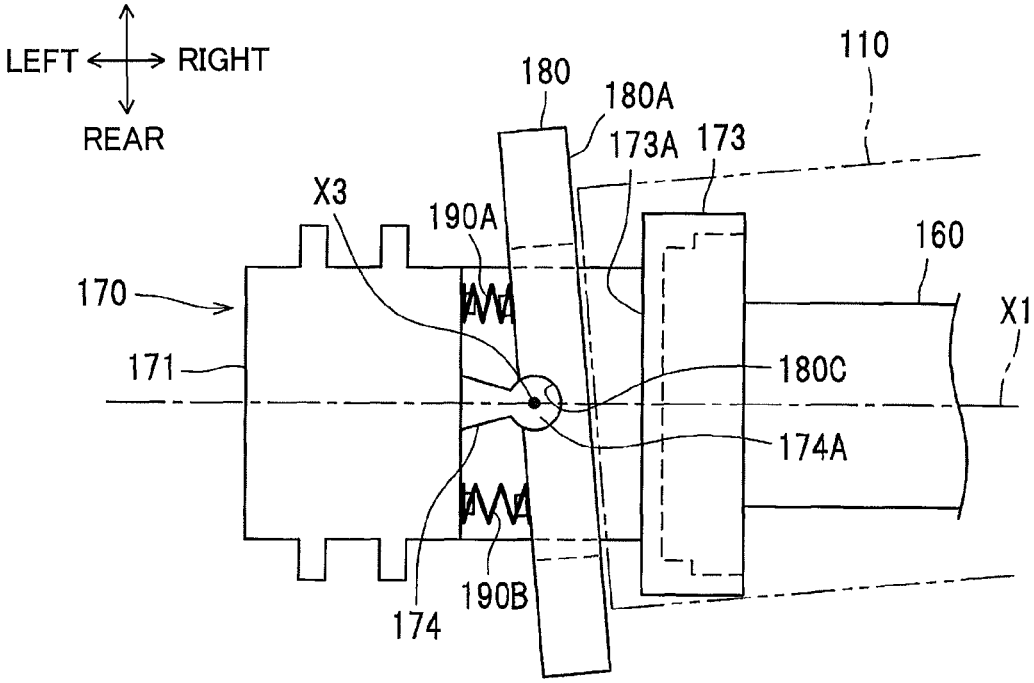
FIG. 10 is a plan view illustrating how the restricting member of the embodiment functions.

The restricting member 180 is tiltably supported to the frame section 171 of the frame 170. Specifically, the restricting member 180 is configured to tilt about a vertical imaginary axis X3 (see FIG. 9) perpendicular to both the imaginary axis X1 and the moving direction of the endless belt 110 shown in FIG. 2. The restricting member 180 is further configured to move back to its initial position (shown in FIG. 9) where the restricting surface 180A extends in a direction perpendicular to the imaginary axis X1 of the endless belt 110, even after the restricting member 180 has once tilted, for example as shown in FIG. 10.

To this end, following structural features are provided in the restricting member 180 and the frame 170. The restricting member 180 has a left surface 180B opposite to the restricting surface 180A. The left surface 180B is formed with a bearing groove 180C extends vertically (see FIG. 7). The bearing groove 180C is positioned center of the left surface 180B in the front-rear direction. The bearing groove 180C has a generally semicircular shaped cross-section in a top view.

Figure 8:
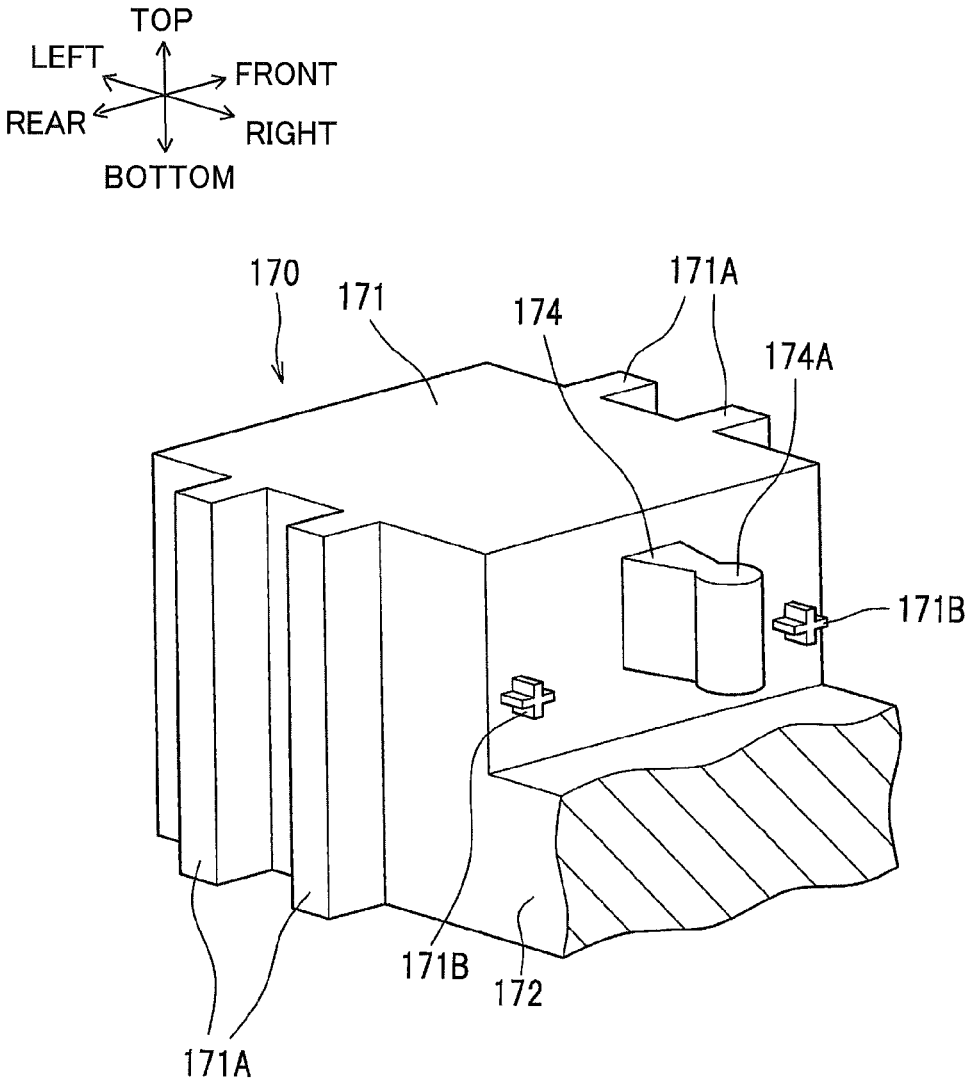
FIG. 8 is a partially-enlarged perspective view of the frame according to the embodiment.

On the other hand, the supporting portion 174 of the frame section 171 has a protruding end integrally formed with a shaft portion 174A, as shown in FIG. 8. The shaft portion 174A has a generally columnar shape extending vertically. The bearing groove 180C of the restricting member 180 is coupled to the shaft portion 174A of the frame section 171 from above. That is, the restricting member 180 is connected to the frame section 171 via the bearing groove 180C engaging with the shaft portion 174A. The restricting member 180 is therefore configured to be detached from the shaft portion 174A only in the vertical direction (the restricting member 180 is non-detachable in all directions except the vertical direction).

With this structure, the supporting portion 174 serves to regulate movement of the restricting member 180. Here, assume a reference plane RP is defined as a plane that is perpendicular to the imaginary axis X1 of the endless belt 110 (see FIG. 9). The supporting portion 174 serves to permit the restricting member 180 to restore its initial position where the restricting surface 180A is parallel to the reference plane RP in conjunction with biasing forces of the compression springs 190A, 190B.

The restricting member 180B is also formed with a pair of spring receiving bosses 183, 183 in opposition to the pair of spring receiving bosses 171B, 171B of the right side wall of the frame section 171. The spring receiving bosses 183, 183 are provided to oppose each other in the front-rear direction. The spring receiving bosses 183, 183 are bosses having a generally cross-like shape in cross-section.

Between the right side wall of the frame section 171 and the left surface 180B of the restricting member 180, a pair of compression spring 190A, 190B is provided. Specifically, the compression spring 190A has both ends engaged with the front spring receiving boss 171B and front spring receiving boss 183 respectively and is disposed between the front spring receiving boss 171B and front spring receiving boss 183 in a compressed state. Likewise, the compression spring 190B is disposed between the rear spring receiving boss 171B and rear spring receiving boss 183 in a compressed state, while both ends of the compression spring 190B are engaged with the corresponding spring receiving bosses 171B, 183.

Due to biasing forces of the compression springs 190A and 190B, the restricting surface 180A is configured to be biased toward the axial end face of the endless belt 110.

The imaginary axis X3 is defined by the shaft portion 174A of the frame section 171 and the bearing groove 180C of the restricting member 180, as shown in FIG. 9. The imaginary axis X3 (more precisely, the shaft portion 174A engaging with the bearing groove 180C) is positioned inward of the endless belt 110 (at the internal space of the endless belt 110) and between the compression spring 190A and the compression spring 190B as viewed in the imaginary axial direction X1.

The shaft portion 174A (supporting portion 174), the bearing groove 180C, the compression springs 190A and 190B constitute a tilting mechanism of the present embodiment that enables the restricting member 180 to tilt relative to the frame 170. With this tilting mechanism, the restricting surface 180A of the restricting member 180 is configured to tilt (move) between the initial position (FIG. 9) where the restricting surface 180A is parallel to the reference plane RP and a tilted position (FIG. 10 as an example) where the restricting surface 180A is tilted relative to the reference plane RP by a prescribed amount.

In the fixing device 100 of the depicted embodiment, initially, the restricting surface 180A of the restricting member 180 extends in a direction parallel to the reference plane RP that is perpendicular to the imaginary axis X1 of the endless belt 110, as shown in FIG. 9. This position of the endless belt 110 shown in FIG. 9 will be referred to as a reference position of the endless belt 110, hereinafter.

The endless belt 110 has the rubber layer 112, as shown in FIG. 3. The endless belt 110 of the present embodiment could thus generate a relatively strong gripping force with the pressure roller 150, compared to an endless belt without a rubber layer. As a result, conceivably, a relatively strong pressing force generated due to sliding contact between the endless belt 110 and the pressure roller 150 may be exerted on the endless belt 110 in the imaginary axial direction X1, thereby causing displacement of the endless belt 110 in the axial direction. If the axial end face of the endless belt 110 slants relative to the reference plane RP upon displacement of the endless belt 110, only a portion of the axial end face of the endless belt 110 may be tightly pressed against the corresponding restricting surface 180A of the restricting member 180.

One of such cases is illustrated in FIG. 10 as an example. In this example, due to the pressing force exerted on the endless belt 110, the axial end face (left end face) of the endless belt 110 is assumed to be pressed against the restricting surface 180A unevenly and strongly toward frontward. In this case, the above-described construction of the present embodiment enables the compression spring 190A to contract while enables the compression spring 190B to expand, causing the restricting surface 180A to tilt (pivot counterclockwise in FIG. 10 about the imaginary axis X3) such that the axial end face of the endless belt 110 is pressed against the restricting surface 180A with a uniform contact pressure. As a result, damages or distortion to the axial end face of the endless belt 110 can be prevented.

Incidentally, the pressing force of the endless belt 110 against the restricting surface 180A decreases as a result of the tilting of the restricting surface 180A. The compression spring 190A now expands and the compression spring 190B contracts, which causes the restricting member 180 to tilt clockwise in FIG. 10 about the imaginary axis X3 to move the restricting member 180 back to the initial position shown in FIG. 9. In the meantime, the restricting surface 180A of the restricting member 180 pushes the axial end face of the endless belt 110 rightward and rearward, enabling the endless belt 110 to move back to its reference position shown in FIG. 9.

Even after the restricting surface 180A has moved back to the initial position, the restricting member 180 can tilt such that the restricting surface 180A evenly abuts on the corresponding axial end face of the endless belt 110 each time the axial end face of the endless belt 110 is unevenly pressed against the restricting surface 180A. Hence, damages or distortion to the axial end faces of the endless belt 110 can be repeatedly prevented.

As described above, with the construction of the fixing device 100 according to the present embodiment, the restricting member 180 (restricting surface 180A) is configured to tilt following slanting of the endless belt 110 relative to the imaginary axis X1, even if the axial end face of the endless belt 110 is pressed strongly and unevenly against the restricting surface 180A. Hence, the restricting surface 180A can abut against the axial end face of the endless belt 110 evenly with uniform contact pressure, and the axial end faces of the endless belt 110 can therefore be prevented from being damaged or distorted repeatedly.

The tilting of the restricting surface 180A results in decrease in pressing force of the axial end face of the endless belt 110 against the restricting surface 180A. As a result, the restricting member 180 is caused to tilt such that the restricting surface 180A restores its initial position. The endless belt 110 can thus move back to its reference position as shown in FIG. 9.

Various modifications are conceivable.

Hereinafter, first to third modifications to the above-described embodiment will be described with reference to FIGS. 11 through 14, wherein like parts and components are designated by the same reference numerals with those of the depicted embodiment to avoid duplicating description.

Figure 11:
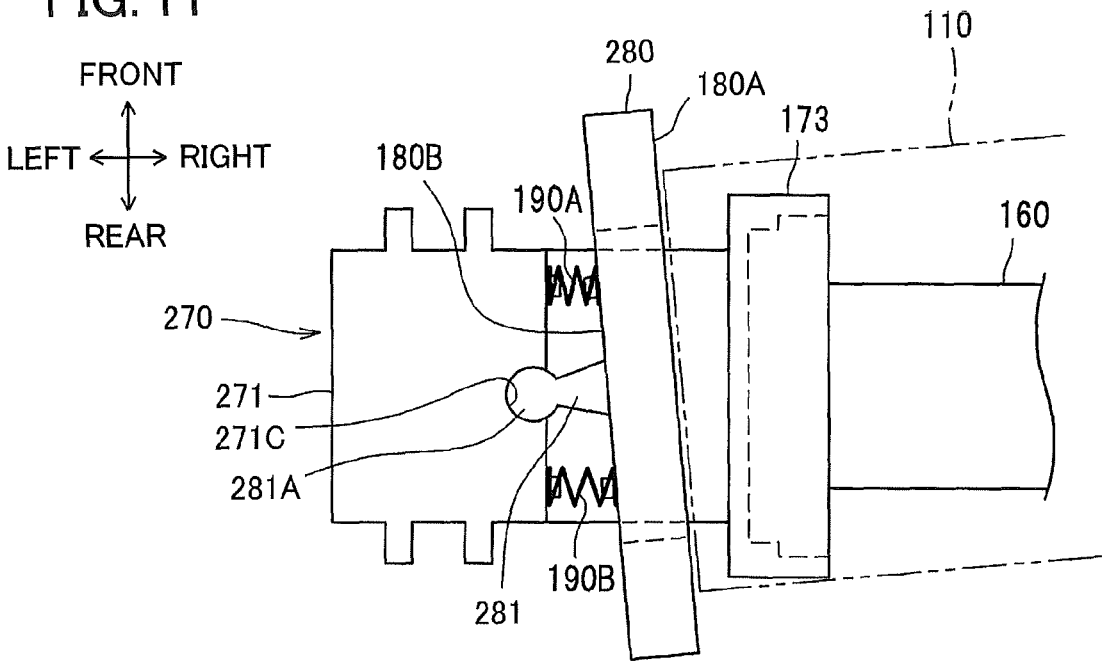
FIG. 11 is a plan view showing an assembled state of a frame and a restricting member according to a first modification to the embodiment.

FIG. 11 shows a tilting mechanism according to a first modification to the depicted embodiment.

In the first modification, the bearing groove 180C of the restricting member 180 and the supporting portion 174 of the frame section 171 in the tilting mechanism of the depicted embodiment (see FIG. 9) are interchanged with each other. Specifically, a restricting member 280 of the first modification is provided with a supporting portion 281 instead of the bearing groove 180C, while a frame section 271 of a frame 270 of the first modification is formed with a bearing groove 271C instead of the supporting portion 174.

The supporting portion 281 has the same construction with the supporting portion 174 of the embodiment. That is, the supporting portion 281 is formed on a left surface 280B of the restricting member 280 to protrude leftward therefrom and has a protruding end provided with a shaft portion 281A. The supporting portion 281 has the same construction with the shaft portion 174A of the embodiment. The shaft portion 281A and the supporting portion 281 are integral with each other.

The bearing groove 271C has the same construction with the bearing groove 180C of the embodiment and is formed in a right side wall (upper portion of the right side wall above the arm section 172) of the frame section 271.

This construction of the tilting mechanism according to the first modification achieves the same technical advantages with the depicted embodiment.

Figure 12:
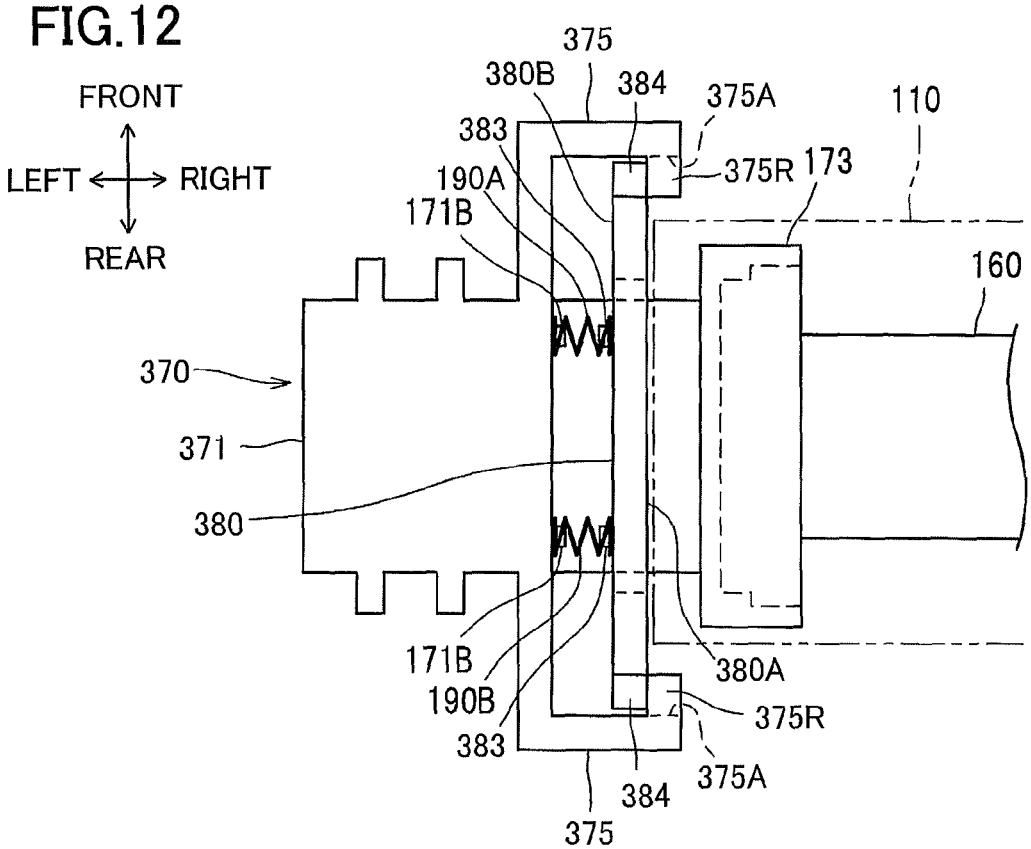
FIG. 12 is a plan view showing an assembled state of a frame and a restricting member according to a second modification to the embodiment.

FIG. 12 shows a tilting mechanism according to a second modification to the depicted embodiment.

Figure 13:
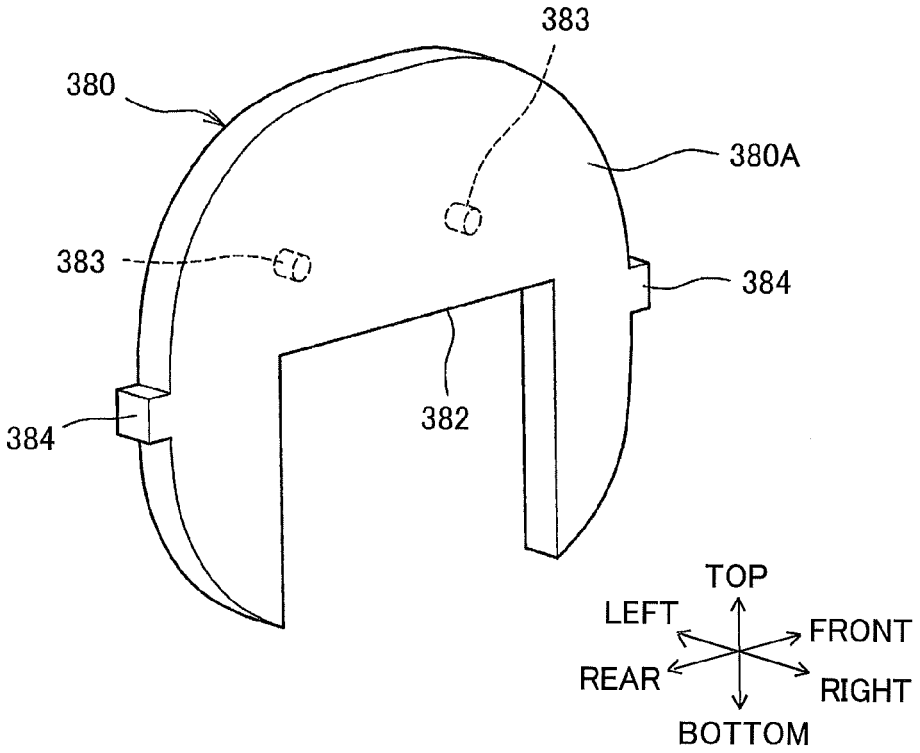
FIG. 13 is a perspective view of the restricting member according to the second modification.

A restricting member 380 of the second modification is dispensed with the bearing groove 180C on its left surface 380B, as shown in FIGS. 12 and 13. Instead, the restricting member 380 is formed with a pair of engaging protrusions 384, 384 on a circumferential surface of the restricting member 380. More specifically, the engaging protrusions 384, 384 are formed on front and rear end portions on the circumferential surface of the restricting member 380 to oppose each other in the front-rear direction. The restricting member 380 has a pair of spring receiving bosses 383, 383 on the left surface 380B, instead of the spring receiving bosses 183, 183 of the embodiment. The spring receiving bosses 383, 383 are columnar shaped having a circular shaped cross-section. The restricting member 380 has a right surface 380A serving as a restricting surface 380A. The restricting member 180 is also formed with a coupling recess 382 for assembling the restricting member 380 to the frame 370.

A frame section 371 of a frame 370 of the third modification has front and rear portions formed with a pair of arms 375, 375. The arms 375, 375 serve to restrict movement of the restricting member 380 in the second modification. In other words, the arms 375, 375 function to regulate the restricting member 380 to move such that the restricting surface 380A is configured to move back to its initial position (shown in FIG. 12) after tilting in accordance with slanting of the endless belt 110.

The arms 375, 375 are integrally formed with the frame section 371. The arms 375, 375 extend from the front and rear portions of the frame section 371 respectively so as to movably support the restricting member 380 therebetween.

Specifically, each arm 375 has a general L-like shape in a top view as shown in FIG. 12. Each of the L-shaped arms 375, 375 has a distal end formed with a restricting portion 375R extending parallel to the reference plane RP toward the imaginary axis X1 of the endless belt 110. The restricting portion 375R of each arm 375 is formed with a cutout 375A that allows passage of the corresponding engaging protrusion 384 of the restricting member 380 at the time of assembly of the restricting member 380 to the frame 370.

The compression springs 190A and 190B are disposed between a right side wall of the frame section 371 and the left surface 380B of the restricting member 380, as in the depicted embodiment. The compression springs 190A and 190B are configured to normally bias the restricting member 380 toward the restricting portions 375R (inward in the left-right direction or the imaginary axial direction X1) such that the restricting surface 380A is in abutment with the restricting portions 375R of the arms 375, 375 in the initial position. The restricting member 380 is thus movable in the left-right direction within a space enclosed by the arms 375, 375 due to the biasing forces of the compression springs 190A and 190B.

This construction of the tilting mechanism according to the second modification achieves the same technical advantages with the depicted embodiment.

Figure 14:
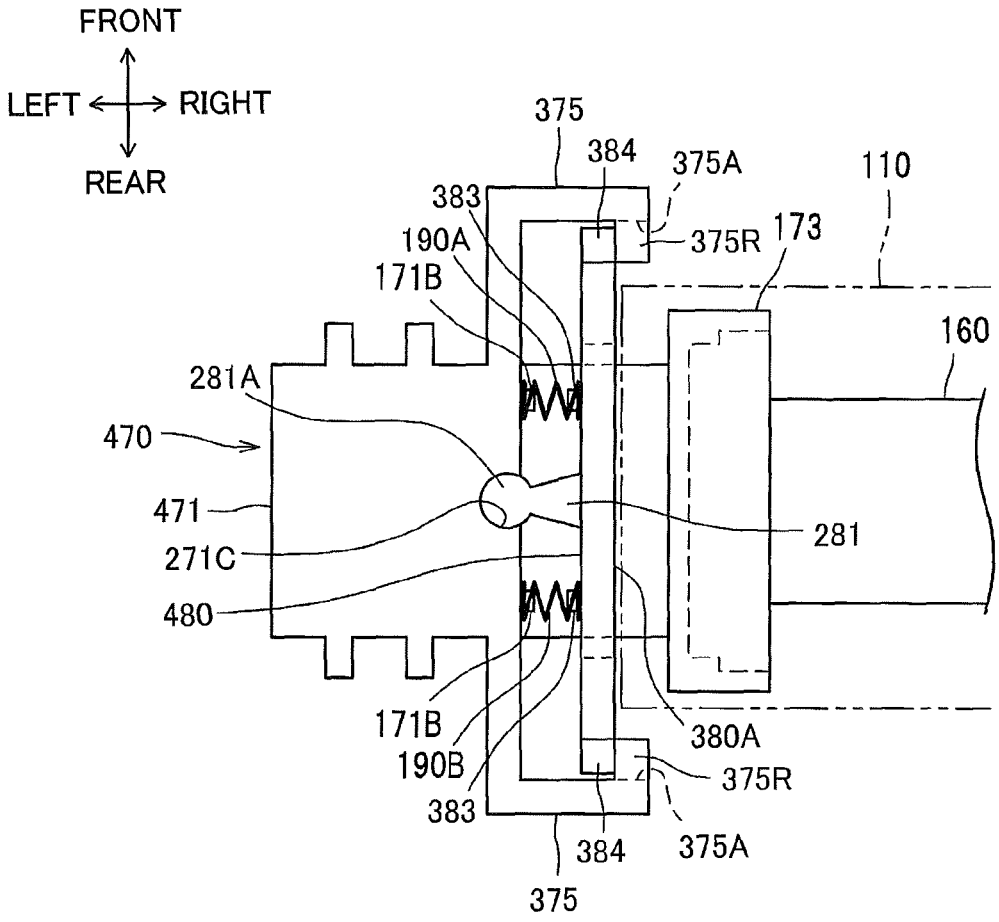
FIG. 14 is a plan view showing an assembled state of a frame and a restricting member according to a fourth modification to the embodiment.

FIG. 14 shows a tilting mechanism according to a third modification to the depicted embodiment.

The third modification of the embodiment is a combination of the first and second modifications. That is, a restricting member 480 of the third modification includes the supporting portion 281, shaft portion 281A, the pair of engaging protrusions 384, 384, and the spring receiving bosses 383, 383. A frame 470 of the third modification includes a frame section 471 provided with the arms 375, 375 and the bearing groove 271C.

This construction of the tilting mechanism according to the third modification achieves the same technical advantages with the depicted embodiment.

As another alternative construction, the bearing groove 180C of the restricting member 180 of the depicted embodiment may be a spherical-shaped receiving portion (not show in drawings), while the shaft portion 174A of the frame section 171 of the depicted embodiment may be formed in a spherical shape (not show in drawings) to permit surface contact with the spherical-shaped receiving portion.

Further, instead of the endless belt 110 of the embodiment having three-layered structure, a single-layered endless belt configured solely of the base layer 111 (see FIG. 3) may also be available. Further, the endless belt 110 of the embodiment may have or may not have a seam.

As illustrated in FIGS. 8 and 13, the spring receiving bosses of the restricting member may have a cross-shaped cross-section as in the embodiment or may have a circular shaped cross-section as in the second modification.

It should be noted that, in the fixing device 100 of the present invention, "contact with the inner peripheral surface of the endless belt 110" may include both "direct contact" with the inner peripheral surface and "indirect contact" with the inner peripheral surface via other layer-shaped member.

While the invention has been described in detail with reference to the embodiments thereof, it would be apparent to those skilled in the art that various changes and modifications may be made therein without departing from the spirit of the invention.

What is claimed is:

1. A fixing device comprising:

an endless belt having an inner peripheral surface defining an internal space and configured to circularly move about a first axis extending in an axial direction, the endless belt having an axial end face;

a heater extending through the internal space;

a nip member extending through the internal space, the endless belt being circularly movable in a moving direction generally perpendicular to the axial direction relative to the nip member;

a rotary body, the rotary body and the nip member being configured to nip the endless belt therebetween;

a restricting member configured to restrict displacement of the endless belt in the axial direction, the restricting member having a restricting surface configured to oppose the axial end face of the endless belt in the axial direction and an opposing surface opposing the restricting surface, the restricting surface being configured to abut with the axial end face of the endless belt upon displacement of the endless belt, the restricting surface being moved between an initial position and a tilted position in accordance with abutment with the axial end face of the endless belt, the restricting surface at the initial position being generally parallel to a reference plane generally perpendicular to the axial direction, and the restricting surface at the tilted position being tilted relative to the reference plane;

a first spring and a second spring disposed spaced away from each other in the moving direction and configured to bias the opposing surface of the restricting member toward the axial end face of the endless belt;

a frame, the frame including a base portion supporting the first spring and the second spring; and a movement restricting portion configured to permit the restricting surface to tilt from the tilted position to the initial position in conjunction with the first spring and the second spring upon displacement of the endless belt, wherein the movement restricting portion comprises a pair of arms extending from the base portion of the frame toward the restricting member and engaging the restricting member, and wherein the first spring and the second spring are disposed between the base portion of the frame and the opposing surface of the restricting member, the restricting member being supported by the frame through the pair of arms such that the restricting member is capable of tilting between the initial position and the tilted position relative to the frame.

2. The fixing device as claimed in claim 1, wherein the movement restricting portion comprises a supporting portion defining a second axis perpendicular to the axial direction and the moving direction, the restricting member being supported by the frame through the supporting portion such that the restricting member is capable of tilting about the second axis; and wherein the supporting portion is positioned at the internal space defined by the inner peripheral surface of the endless belt and between the first spring and the second spring when the restricting member is viewed in the axial direction.

3. The fixing device as claimed in claim 2, wherein the opposing surface has a recessed portion; and wherein the frame has a protruding portion protruding from the base portion toward the opposing surface, the protruding portion engaging with the recessed portion of the restricting member to constitute the supporting portion such that the recessed portion is capable of tilting relative to the protruding portion about the second axis.

4. The fixing device as claimed in claim 2, wherein the opposing surface has a protruding portion protruding therefrom; and wherein the frame has a recessed portion formed in the base portion, the protruding portion protruding from the opposing surface toward the recessed portion, the protruding portion engaging with the recessed portion to constitute the supporting portion such that the protruding portion is capable of tilting relative to the recessed portion about the second axis.

5. The fixing device as claimed in claim 1, wherein the first spring and the second spring are compressed springs and provided on the opposing surface.

6. The fixing device as claimed in claim 5, wherein the opposing surface is formed with a pair of protrusions supporting the first spring and the second spring respectively for positioning the first spring and the second spring relative to the restricting member.

7. The fixing device as claimed in claim 1, wherein the endless belt comprises a base layer, a rubber layer coating the base layer and serving as an intermediate layer, and a fluorine resin layer coating the rubber layer and serving as an outermost layer.

8. The fixing device as claimed in claim 1, wherein the restricting member is configured to tilt about a second axis perpendicular to the axial direction of the endless belt, and wherein the second axis passes through, at the internal space of the endless belt, a gap between the first spring and the second spring when viewed in the axial direction of the endless belt.

* * * * *